United States Patent [19]

Watanabe et al.

[11] Patent Number: 4,573,443

[45] Date of Patent: Mar. 4, 1986

[54] NON-SYNCHRONOUS INJECTION ACCELERATION CONTROL FOR A MULTICYLINDER INTERNAL COMBUSTION ENGINE

[75] Inventors: Haruo Watanabe; Kazuo Nakano, both of Okazaki; Akito Ohnishi, Toyota, all of Japan

[73] Assignee: Toyota Jidosha Kabushiki Kaisha, Toyota, Japan

[21] Appl. No.: 734,816

[22] Filed: May 16, 1985

Related U.S. Application Data

[63] Continuation of Ser. No. 504,946, Jun. 16, 1983, abandoned.

[30] Foreign Application Priority Data

Sep. 16, 1982 [JP] Japan ..... 57-159446

[51] Int. Cl.[4] ..... R02B 3/10

[52] U.S. Cl. ..... 123/492; 123/478; 123/480; 123/481

[58] Field of Search ..... 123/492, 478, 480, 481

[56] References Cited

U.S. PATENT DOCUMENTS

| | | | |
|---|---|---|---|
| 4,296,722 | 10/1981 | Furuhashi et al. | 123/492 |
| 4,327,682 | 5/1982 | Harada | 123/492 |
| 4,356,803 | 11/1982 | Miyagi | 123/492 |
| 4,408,279 | 10/1983 | Imai et al. | 123/492 |
| 4,408,588 | 10/1983 | Mausner | 123/492 |
| 4,411,232 | 10/1983 | Atago et al. | 123/492 |

*Primary Examiner*—Raymond A. Nelli

*Attorney, Agent, or Firm*—Cushman, Darby & Cushman

[57] ABSTRACT

An apparatus for controlling fuel injection in a multicylinder internal combustion engine, wherein fuel injectors for each cylinder are simultaneously operated synchronous with crank angles. The amount of injection is controlled by signals from an air flow meter. The apparatus includes a system operating, nonsynchronous with crank angles, the injectors when the engine is accelerated. The amount of nonsynchronous fuel injection is controlled in accordance with the position of the nonsynchronous injection (i.e., occurrence of acceleration) between adjacent synchronous injections.

6 Claims, 7 Drawing Figures

NON-SYNCHRONOUS INJECTION ACCELERATION CONTROL FOR A MULTICYLINDER INTERNAL COMBUSTION ENGINE

This is a continuation of application Ser. No. 504,946, filed June 16, 1983, now abandoned.

BACKGROUND OF THE INVENTION

1. Field of the Invention

The present invention relates to an internal combustion engine wherein fuel injection is controlled by an electronic system.

2. Description of the Prior Art

In an internal combustion engine wherein the fuel injection is controlled by an electronic system, the amount of the fuel to be injected is calculated in accordance with signals from intake air and other engine sensors. Fuel injectors are operated for a period corresponding to the calculated fuel amount and in synchronism with crank angles.

A typical intake air sensor is a so-called airflow meter. The response speed of air flow, however, is slow when the throttle valve is opened at a higher-than-predetermined speed. This delay results in a shortage of fuel during engine acceleration. To overcome this problem, it has been proposed to detect engine acceleration states and operate the fuel injectors at periods nonsynchronous with the crank angle, so as to enable a sufficient fuel supply from the start of acceleration despite the delayed response. In this case, however, a large nonsynchronous injection is necessary when the acceleration is effected just before or just after synchronized injections. Such a large nonsynchronous injection results in the presence of excess fuel in some cylinders during acceleration other than at the above times.

This occurs due to the following reason. In a multicylinder engine, a separate fuel injector is provided for each cylinder. Some or all of the injectors are simultaneously operated at predetermined crank angles, such as 360°. A complete engine cycle corresponds to a crank angle of 720°.

On the other hand, the intake stroke occupies a crank angle of 180°. Thus, in a four-cylinder engine, each cylinder receives two fuel injections from the end of one of its intake strokes to the end of its next intake stroke.

In the prior art electronically controlled fuel injection engine, in addition to the two fuel injections, cylinders would also receive nonsynchronous injections due to acceleration. Such nonsynchronous fuel injections, however, would not only affect the intake stroke of one cylinder directly after the acceleration, but also the succeeding intake stroke of another cylinder, due to the above mentioned facts.

If the acceleration does not occur just before or after a synchronous fuel injection, however, the synchronous fuel injection after the nonsynchronous fuel injection will take place with an amount of air from the air flow meter while the meter has begun its response. The additional amount of fuel from the nonsynchronous fuel injection then causes excess combustion in the cylinder, resulting in decreased output.

SUMMARY OF THE INVENTION

An object of the present invention is to provide an internal combustion engine with an apparatus for controlling fuel injection capable of properly compensating the fuel amount during acceleration irrespective of the position of the acceleration relative to a synchronous fuel injection.

According to the present invention fuel-injection controlled internal combustion engine is provided comprising:

an engine body provided with a plurality of cylinders;

an intake line for introduction of intake air;

an exhaust line for removal of exhaust gas;

an injector means for controlling fuel injection in the intake line;

a means for detecting the amount of air flow in said intake line and providing signals representing the same;

a means for operating the injector means synchronous with crank angles of a predetermined interval for causing the fuel to be supplied from the injector;

a means for detecting an acceleration condition of the engine;

a means for determining a position where the acceleration is started relative to adjacent synchronous fuel injections; and a means responsive to signals from the detecting means for operating, nonsynchronous with the syncrhonous fuel injections, the injector means, the fuel amount of the nonsynchronous injections being determined in accordance with the relative position of the acceleration start.

BRIEF DESCRIPTION OF THE DRAWINGS

An embodiment of the present invention is now described with reference to attached drawing, in which.

DESCRIPTION OF THE PREFERRED EMBODIMENT

Figure 1:
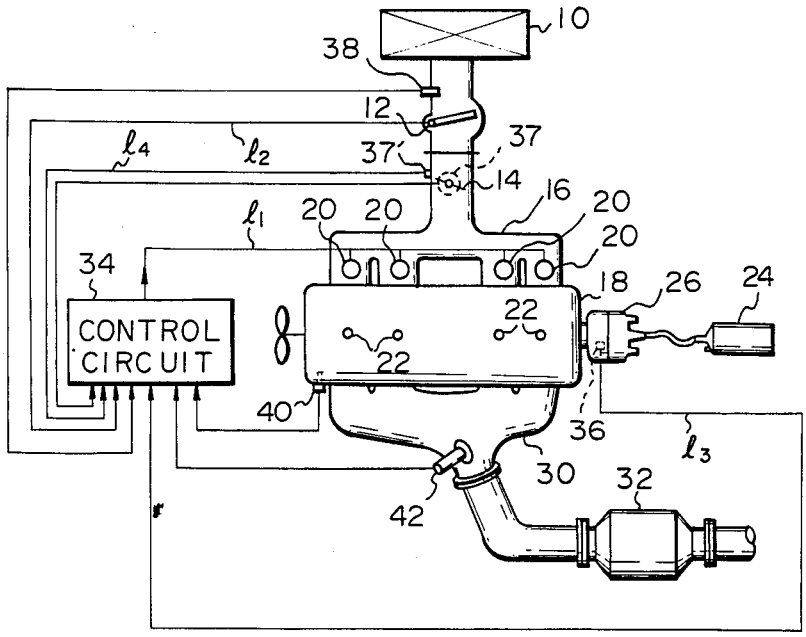
FIG. 1 is a view of a general construction of an internal combustion engine according to the present invention.

In FIG. 1, air is taken in from air cleaner 10 in an amount measured by an air flow meter 12. The air is introduced via a throttle valve 14 into an intake manifold 16. The air in the intake manifold 16 is, together with fuel from fuel injectors 20 arranged for each cylinder of the engine, introduced into combustion chambers of the cylinders in an engine body 18. Reference numerals 22 denote spark plugs having spark electrodes opening into the combustion chambers. The spark plugs 22 are connected via a distributor 26 to an ignition coil 24, and they cause the air-fuel mixture introduced into the combustion chambers to be ignited and burned. The resultant gas is exhausted to an exhaust manifold 30 and is directed to a catalytic convertor 32.

Reference numeral 34 denotes a control circuit which receives electric signals from various operation condition sensors, such as the air flow meter 12, so as to control the fuel injectors 20. The control circuit 34 comprises a microcomputer system and is connected to the fuel injectors via line $l_1$. The air flow meter 12 generates electric signals, indicating the amount of the intake air, which are input to the control circuit 34 via line $l_2$. A crank angle sensor 36 is arranged in the distributor 26 for providing signals indicating the crankshaft position. The signals are introduced into the control circuit 34 via a line $l_3$. A sensor 37' for detecting a fully closed position of the throttle valve 14 is connected to the control circuit 34 via a line $l_4$. In addition to these sensors, electric signals are introduced into the control circuit 34 from a throttle sensor 37, an intake air temperature sensor 38, a cooling water temperature sensor 40, and an $O_2$ sensor 42, detailed descriptions of which are omitted because these elements are not directly related to the present invention.

Figure 2:
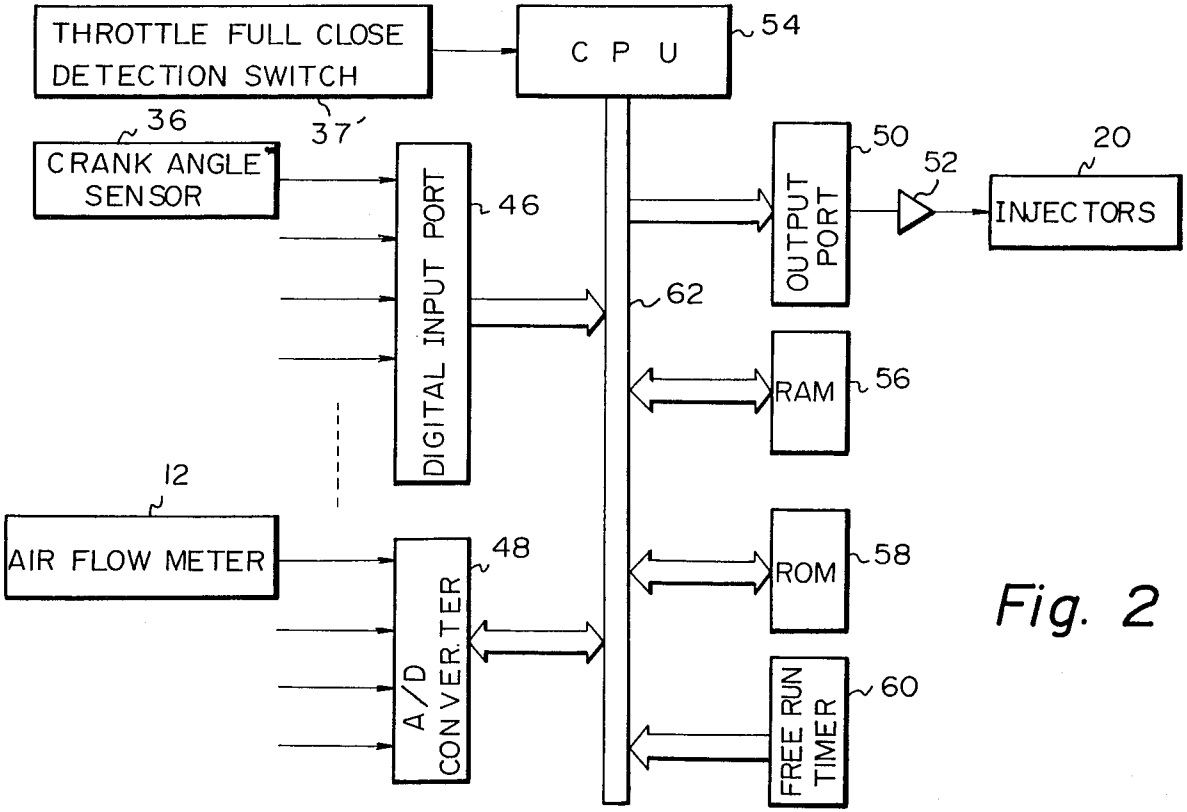
FIG. 2 is a block diagram of a control circuit in FIG. 1.

FIG. 2 is a block diagram of the control circuit 34. Reference numeral 46 indicates a digital inlet port adapted for receiving signals from the crank angle sensor 36 and the other digital sensors (not shown). Reference numeral 48 denotes an analog-to-digital (A/D) convertor adapted for converting the analog signals from the air flow meter 12 and other analog sensors (not shown) into digital signals. An output port 50 is connected via an amplifier 52 to the injectors 20. The input port 46, A/D convertor 48, and the output port 50 are connected via a bus 62 to a central processing unit (CPU) 54, a random access memory (RAM) 56, a read only memory (ROM) 58, and a free run timer 60, which are the constructional components of a microcomputer system. A switch 37' for detection of the fully closed position of the throttle valve 14 is connected to an interruption port of the CPU 54.

Figure 3:
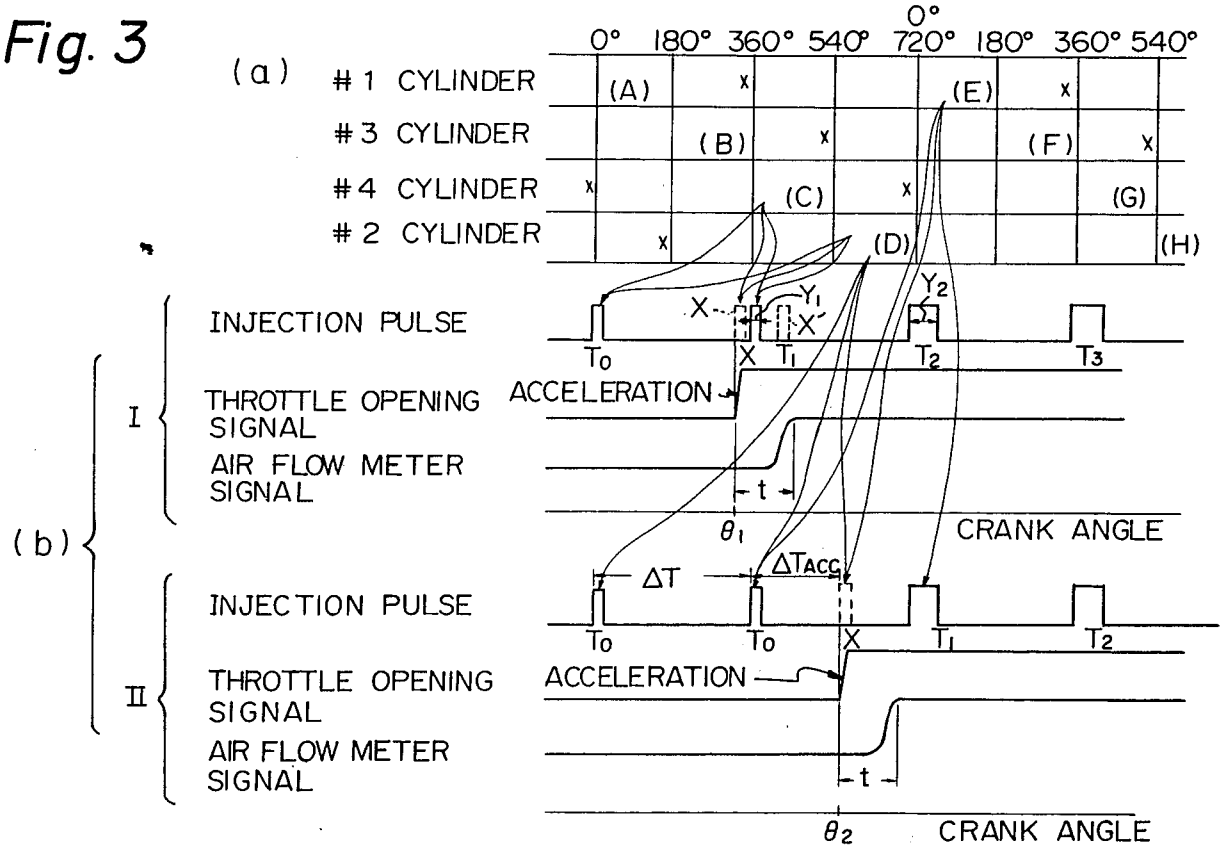
FIG. 3 shows crank angle regions for intake strokes for each cylinder and shows injection pulses, throttle opening, signals and air flow meter signals (b) for a case I where nonsynchronous injection is effected near synchronous injection and a case II where nonsynchronous injection is effected away from the synchronous injection.

The control circuit 34 functions according to the present invention. Prior to describing the contruction, the principle of fuel injection control according to the present invention will be described. FIG. 3-(*a*) shows, for each cylinder of a four-cylinder engine, a series of 180° crank angle regions. At successive of these crank angle regions, intake strokes, compression strokes, power strokes, and exhaust strokes are effected one after another. The crank angle regions for intake strokes are designated by A, B, C, D, E, F, G, and H. The crank angles marked by x are where ignition is effected. As well known to those skilled in the art, they are located at the ends of crank angle regions where compression strokes are effected. As will be clear from FIG. 3, the ignitions are effected in the sequence of the first (#1), third (#3), fourth (#4), and second (#2) cylinders.

FIG. 3-(*b*) shows, in case I, fuel injection pulses, throttle opening signals, and air flow sensor signals with respect to the crank angle. Case I is the case where nonsynchronous fuel injection (x) at acceleration is effected near a synchronous fuel injection ($T_1$).

FIG. 3-(*b*) shows, in case II, substantially the same thing as case I, except that the nonsynchronous fuel injection (x) at acceleration is effected away from the synchronous fuel injections $T_0$ and $T_1$.

With regard to case I, synchronous fuel injection pulses $T_0$, $T_1$, $T_2$ and $T_3$ are issued synchronously with each 360° crank angle. When engine acceleration occurs, e.g., at a crank angle of $\theta_1$, the throttle valve 14 instantaneously changes from the fully closed condition to the fully opened condition. The instantaneous opening of the throttle valve 14 causes the control circuit 34 to consider that acceleration has started and to issue a nonsynchronous fuel injection pulse x at this crank angle $\theta_1$. The air flow meter 12 cannot keep up with this instantaneous throttle valve opening, however, and a delay t occurs before it can attain the steady state. Because of such delay of the response of the air flow meter 12, the width $Y_1$ of the synchronous fuel injection $T_1$ just after the start of acceleration is still small, irrespective of the wide throttle opening. The subsequent synchronous pulse $T_2$ can have a large width $Y_2$ corresponding to the wide throttle opening, because time t has elapsed from the acceleration ($\theta_1$).

With regard to case II, the fuel injection pulses, throttle opening signals, and the air flow meter signals are issued in a similar manner as in case I. However, in this case, the acceleration is started at a crank angle $\theta_2$ away from synchronous pulses.

As described earlier in reference to the prior art, the amount of fuel introduced into any one cylinder during the intake stroke thereof is determined by two preceding synchronous fuel injections and any nonsynchronous fuel injections occurring between the end of the preceding intake stroke and the end of the current intake stroke. Due to the delayed operation of the air flow meter, the air-fuel mixture of some cylinders is not properly controlled for several strokes of the engine after the acceleration. Tables 1 and 2 show, for case I and II, respectively, the effect of this delayed operation on the fuel amount as well as the air-fuel mixture of the intake air for some intake strokes after acceleration.

TABLE 1

| | (Case I) | |
|---|---|---|
| Intake stroke | Effect on fuel amount | Air-fuel mixture |
| C (#4) | $T_0 + x + T_1$ | Lean |
| D (#2) | Same as above | Lean |
| E (#1) | $x + T_1 + T_2$ | Proper |
| F (#3) | Same as above | Proper |

TABLE 2

| | (Case II) | |
|---|---|---|
| Intake stroke | Effect on fuel amount | Air-fuel mixture |
| D (#2) | $T_0 + T_0 + x$ | Lean |
| E (#1) | $T_0 + x + T_1$ | Proper |
| F (#3) | Same as above | Proper |
| G (#4) | $x + T_1 + T_2$ | Substantially proper (slightly rich) |

In case I, after the start of acceleration at the crank angle $\theta_1$, the #4 cylinder and then the #2 cylinder effect intake strokes C and D. Cylinders #4 and #2 are supplied by the two synchronous injections $T_0$ and $T_1$ effected at the piston top dead center position as well as by a nonsynchronous injection x effected at the crank angle $\theta_1$. Because of the delayed response of the air flow meter 12, the injection pulse $T_1$ has a width $Y_1$ not large enough to correspond to the wide opening of throttle valve 14. Thus, the air-fuel mixture in the intake strokes C and D is lean, as shown in Table 1. Case I also applies when the nonsynchronous injection is effected just after the synchronous injection as shown by x' in FIG. 3(*b*)-I, if the nonsynchronous injection x' is effected before the intake stroke C supplied by the synchronous injection prior to the end of the nonsynchronous injection x'.

Case I may be expressed by the following equations.

$$\Delta T_{ACC} < \Delta T/2 \quad (1) \text{ or}$$

$$\Delta T_{ACC} > \Delta T - t \quad (2)$$

wherein $\Delta T$ is the distance in time, between adjacent synchronous pulses and $\Delta T_{acc}$ is the crank angle area between a nonsynchronous pulse and a preceding synchronous pulse.

Equation (1) corresponds to the case where the nonsynchronous injection is, as shown by x', effected just after the synchronous injection $T_1$. It should be noted that intake stroke C ends at the middle distance $\Delta T/2$.

Equation (2) corresponds to the case where the nonsynchronous injection is, as shown by x, effected just before the synchronous injection T. In this case, the syncrhonous injection $T_1$ subsequent to the nonsynchronous injection x take place within a time smaller than t after the acceleration is started.

In case II, cylinder #2, which effects the intake stroke D at the moment of acceleration (crank angle $\theta_2$) become lean because of the delay of the air flow meter. However, in the intake strokes E, F, and G, since the air flow meter has already begun to respond, the air-fuel mixture for each cylinder is proper or substantially proper (slightly rich). Case II is when the nonsynchronous injection is effected at a crank angle area $T_{ACC}$ which may be expressed by the following equation:

$$\Delta T - r \geqq T_{ACC} \geqq \Delta T/2$$

Figure 4:
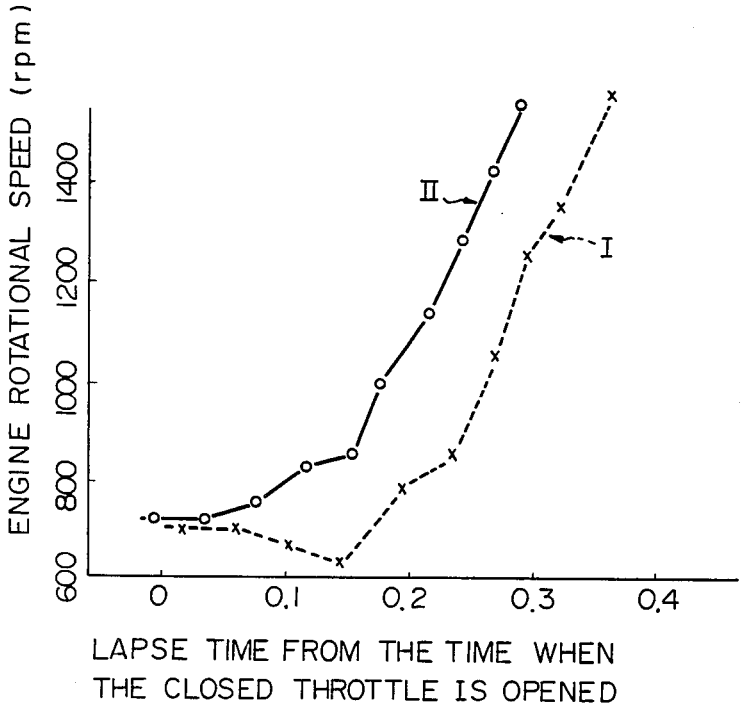
FIG. 4 shows relationships between the time after start of acceleration and engine rotational speed for cases I and II, during racing.

As will be clear from the above, after acceleration is started, there are two cylinders (#4 and #2) with an improper air-fuel ratio of the combustion mixture in case I and one such cylinder (#2) in case II. This difference of the number of cylinders with an improper air fuel ratio causes some difference in acceleration performance between case I and case II. FIG. 4 shows the relationship between the time after the throttle valve 14 is opened and the rotational speed of the engine during no-load racing for cases I and II. As will be easily seen from FIG. 4, the rate of increase of the rotational speed differs between cases I and II. In case II, the speed is easily increased compared with case I. To increase the speed of increase in case I to the same level as that of case II, it can easily be considered to increase the width of the nonsynchronous injection. In this case, the air-fuel ratio of the intake air at C and D in case I (table 1) can be made proper. However, the air-fuel ratio of the intake air at G in case II (table 2) become low (rich), which causes a decreased engine torque as well as increased hydrocarbon and carbon monoxide emission.

To overcome these drawbacks, according to the invention, a means is provided for controlling the width (duration) of the nonsynchronous fuel injection (x) by detecting the time when the acceleration is started. In case I, the width of the nonsynchronous injection is increased to prevent the lean condition of the intake air at the intake strokes C and D. Contrary to this, in case II, the width of the nonsynchronous injection is decreased. As a result of this, the proper air-fuel ratio can be maintain in both cases I and II except for the intake stroke G of case II. This decreased number of cylinders with an improper air-fuel ratio enables idealized control of the air-fuel ratio.

The software for realizing the above-mentioned principle of the present invention is now described with reference to flow charts in FIGS. 5 and 6. Such software is, of course, stored in the ROM 58 in the form of a program.

Figure 5:
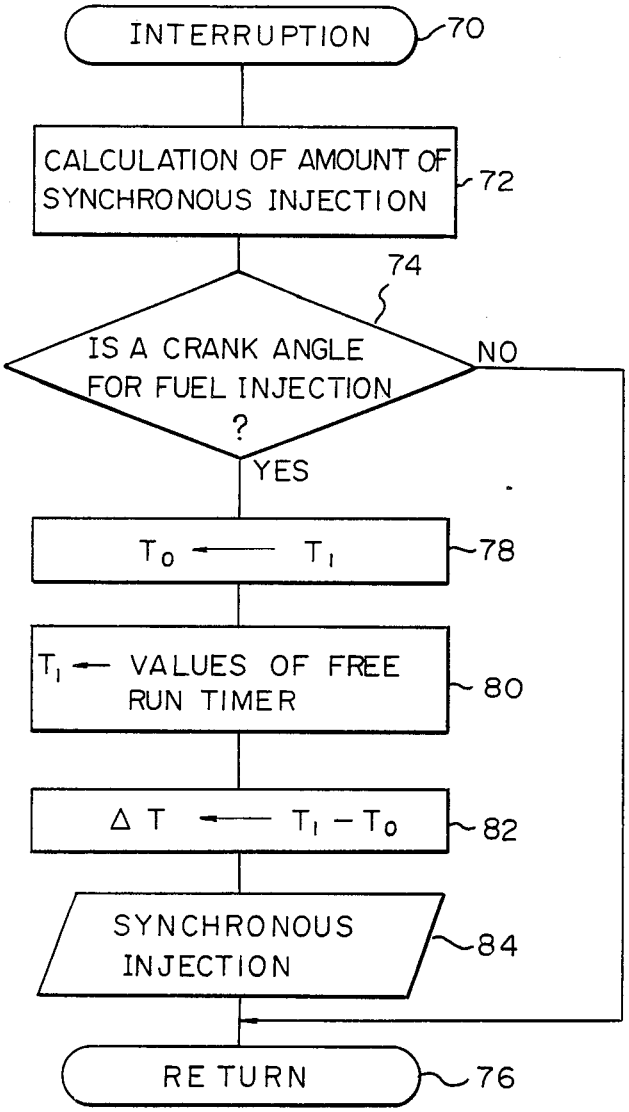
FIG. 5 is a flow chart of a routine for synchronous fuel injection.

In the flow chart of FIG. 5 showing the routine for synchronous fuel injection, the program begins calculation at point 70. At point 72, the amount (period) of the synchronous injection is calculated. The CPU 54 takes the data of the air flow sensor 12 and other sensors to detect the engine operating condition, then determines the amount of the syncrhonous injection, i.e., the width of the synchronous injection. Details of the calculation are not described because they are well known and not directly related to the present invention.

At point 74, it is discriminated whether or not the crank angle as detected by the crank angle sensor 36 is where the synchronous injection is effected. If the result of the discrimination at point 74 is "No", the program proceeds to point 76 to return to the main routine. If the result of the discrimination at point 74 is "Yes", the program proceeds via points 78, 80, and 82 to point 84. At point 84, CPU 54 issues a signal directed to the output port 50 to cause the injectors 20 to operate so that the amount of fuel as calculated at point 72 is injected.

Figure 7:
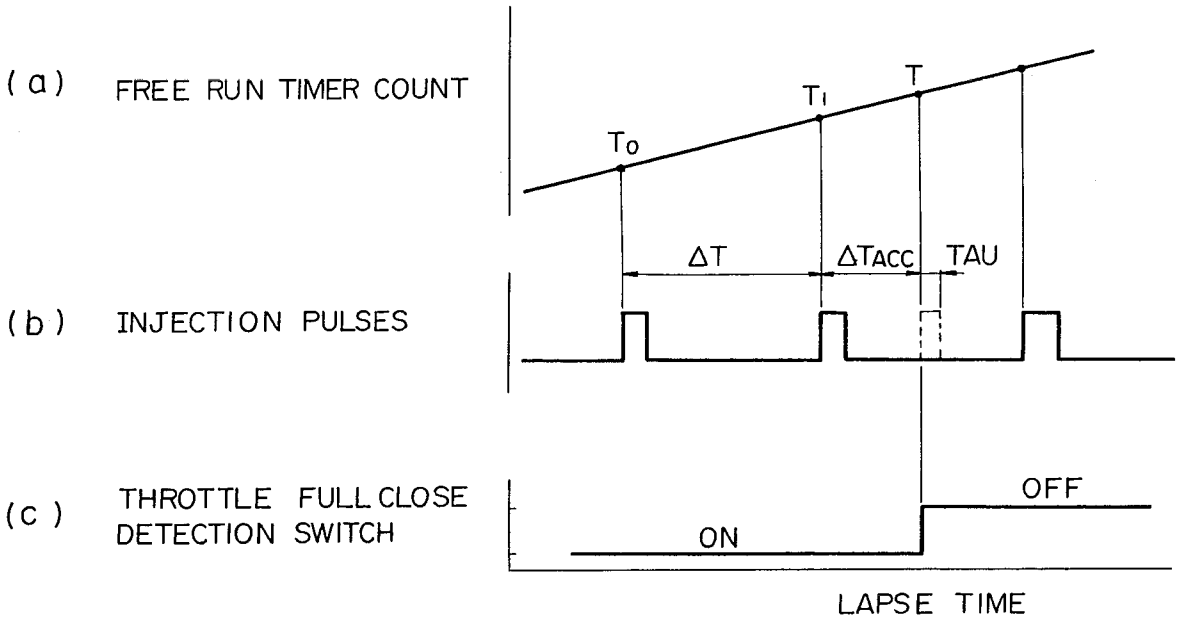
FIG. 7 shows relationships, with respect to time, of a value of a free run timer (a), injection pulses (b), and signals from a throttle full close detection switch (c).

Prior to effecting the synchronous injection at point 84, data stored in the RAM area $T_1$, in which a value of free run timer 60 at the preceding synchronous injection is stored, is moved to the RAM area $T_0$. Then, at point 80, a value of the free run timer at this synchronous injection is loaded to the RAM area $T_1$. At point 82, a difference $T_1 - T_0$ is calculated and then is stored in the RAM area $\Delta T$. This data stored in this area $\Delta T$ corresponds to the distance between adjacent syncrhonous injections. As shown in FIG. 7-(*a*), the count of the free run timer 60 increases in accordance with the lapse of time. The synchronous injection pulses are, as shown in FIG. 7-(*b*), issued every 360° crank angle. If $T_0$ is designated as the count at the preceding synchronous injection and $T_1$ is designated as the count at synchronous injection now effected, $T_1 - T_0$ means, in the sense of time, the distance between two adjacent synchronous injections.

Figure 6:
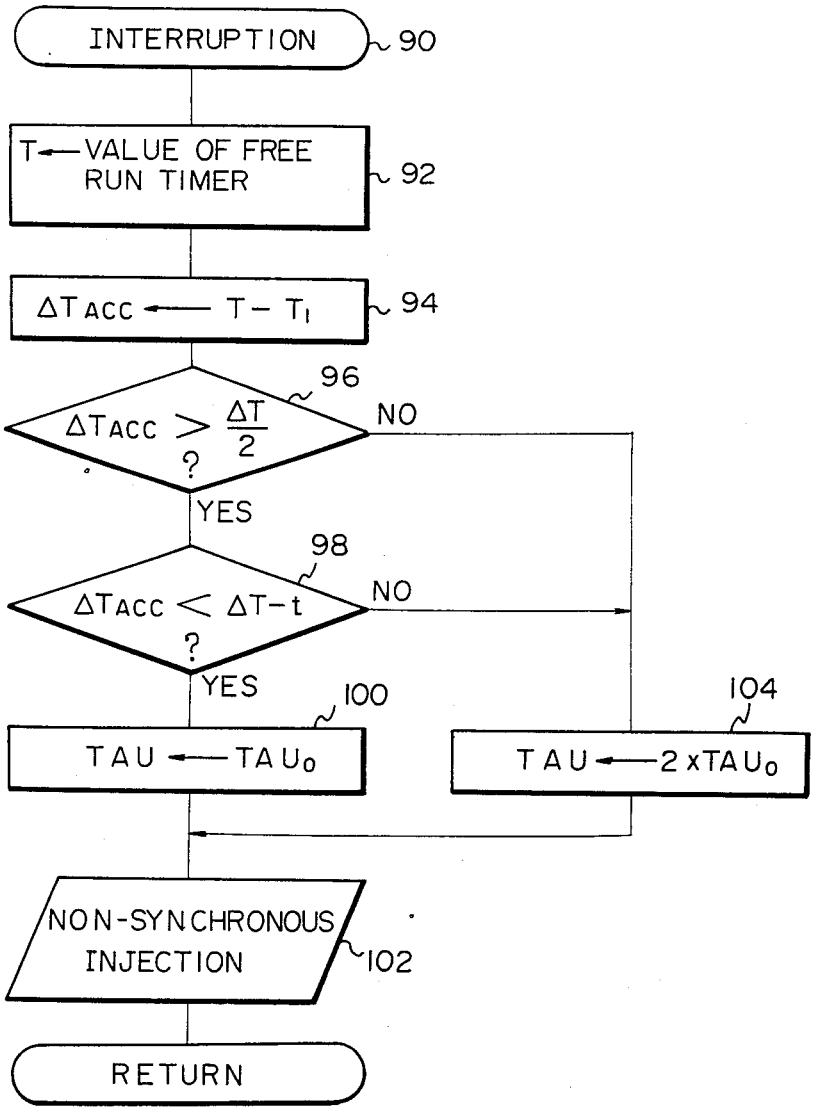
FIG. 6 is a flow chart of a routine for nonsynchronous fuel injection.

FIG. 6 shows a routine for nonsynchronous injection, as a time interruption routine which is started when the throttle valve 14 is opened from the fully closed position, i.e., acceleration is started. As shown in FIG. 7-(*c*), the throttle valve full closing detecting switch 37' is moved from the "on" condition to the "off" condition at the start of acceleration. Then, CPU 54 effects the interruption routine at point 90 in FIG. 6. At next point 92, a value of the free run timer 60 at this instant is stored in an area T of RAM 56. At point 96, the value in T is subtracted by a value in $T_1$. The result of the calculation is stored in RAM as $\Delta T_{ACC}$. At point 96, it is discriminated whether or not $\Delta T_{ACC}$ is larger than $\Delta T/2$. At the next point 98 it is discriminated whether or not $\Delta T_{ACC}$ is smaller than $\Delta T - t$. A "yes" result at both points 96 and 98 means that the position where the nonsynchronous injection is effected is located in case II. In other words, the subsequent synchronous injection is spaced from a preceding or subsequent synchronous injection. In this case, the program then proceeds to point 100 where the width of the nonsynchronous injection TAU is set to $TAU_0$. It should be noted that the value of $TAU_0$ is selected so that a proper air-fuel ratio at intake stroke E, F, and G in Table 2 is obtained. Then, the program proceeds to point 102, where CPU 54 issues a signal to injectors via outlet port 50 for nonsynchronous injection. The program then returns to the main routine.

A "no" result of discrimination at point 96 or 98 means that the crank angle where the nonsynchronous injection is effected is located adjacent to a synchronous injection (case I in FIG. 3). In this case the program then proceeds to point 104, where the width of the nonsynchronous injection is set to $2 \times TAU_0$. Thus the amount of the nonsynchronous injection is increased so that the combustible mixture in the intake stroke C and C can be compensated to a proper condition.

We claim:

1. A fuel-injection controlled internal combustion engine, comprising:

an engine body having a plurality of cylinders;

an intake line for introducing intake air into said engine body;

an exhaust line for removing exhaust gas from said engine body;

injector means for controllably injecting fuel into said intake line;

air flow detecting means for detecting an amount of air flowing through said intake line into said engine body and providing signals representative of said detected amount;

synchronous means for controlling said injector means synchronously with predetermined crank angles to cause fuel to be injected;

means for detecting the occurrence of a wide open throttle acceleration condition of said engine;

acceleration start time determining means for determining the start time of acceleration relative to the time occurrence of two prior and post consecutive synchronous fuel injections, in accordance with one of a detected wide open throttle acceleration condition and a throttle-position indicated acceleration condition; and acceleration pulse means, responsive to said detected acceleration conditions, for operating said injector means to commence acceleration pulse fuel injections with said detected acceleration conditions, the width of said acceleration pulse fuel injections being determined in accordance with said start time occurrence of acceleration determined by said acceleration start time determining means.

2. A combustion engine according to claim 1, wherein said acceleration pulse means comprises means for calculating, in accordance with said determined start time of acceleration, said width of said acceleration pulse fuel injections and means for controlling said injector means to inject fuel according to said calculated width beginning at the time of detected acceleration.

3. A combustion engine according to claim 2, wherein said calculating means comprise first calculation means for calculating said width of acceleration pulse fuel injections whenever the detected start time is relatively large till the occurrence of a synchronous injection and second calculation means for calculating said width of acceleration pulse fuel injections whenever the detected start time is relatively small till the occurrence of a synchronous injection.

4. A combustion engine according to claim 3, wherein said second calculating means comprises a means for multiplying a predetermined constant value by a value calculated by said first calculation means.

5. An internal combustion engine according to claim 1, wherein said acceleration start time determining means comprises a means for discriminating whether occurrence of said acceleration pulse fuel injection is effected at a time relatively near the time occurrence of a synchronous injection, a means for increasing the width of an acceleration pulse fuel injection whenever the time occurrence of an acceleration pulse fuel injection is relatively near the time occurrence of a synchronous injection and a means for decreasing the width of an acceleration pulse feed injection whenever the time occurrence of an acceleration pulse fuel injection is not relatively near the time occurrence of a synchronous injection.

6. An internal combustion engine according to claim 5, wherein said discriminating means comprises a means for determining whether an acceleration pulse fuel injection is effected after a preceding synchronous injection within a time which is smaller than a predetermined delay, and for determining whether an acceleration pulse fuel injection is effected after a preceding synchronous injection within a time which is less than half of the time between two consecutive synchronous injections.

* * * * *